US011753278B2

(12) United States Patent
Brook et al.

(10) Patent No.: US 11,753,278 B2
(45) Date of Patent: Sep. 12, 2023

(54) STAIRLIFT RAIL AND METHOD OF FORMING SAME

(71) Applicant: Bruno Independent Living Aids, Inc., Oconomowoc, WI (US)

(72) Inventors: Allen Edward Brook, Waterford, WI (US); Terrence E. O'Brien, Oconomowoc, WI (US); Roy E. McDaniels, Watertown, WI (US); Scott Martin Hall, Sussex, WI (US); Matthew R. Peterson, Brookfield, WI (US); Jeffrey Franklin Marcheske, Waukesha, WI (US)

(73) Assignee: BRUNO INDEPENDENT LIVING AIDS, INC., Oconomowoc, WI (US)

( * ) Notice: Subject to any disclaimer, the term of this patent is extended or adjusted under 35 U.S.C. 154(b) by 0 days.

(21) Appl. No.: 17/595,699

(22) PCT Filed: May 28, 2020

(86) PCT No.: PCT/US2020/034819

§ 371 (c)(1),
(2) Date: Nov. 22, 2021

(87) PCT Pub. No.: WO2020/243233

PCT Pub. Date: Dec. 3, 2020

(65) Prior Publication Data

US 2022/0081257 A1 Mar. 17, 2022

Related U.S. Application Data

(60) Provisional application No. 62/886,620, filed on Aug. 14, 2019, provisional application No. 62/855,119, filed on May 31, 2019.

(51) Int. Cl.
*B66B 9/00* (2006.01)
*B66B 9/08* (2006.01)

(52) U.S. Cl.
CPC ..... *B66B 9/0846* (2013.01)

(58) Field of Classification Search
CPC ..... B66B 9/0846; B66B 9/08; B66B 9/0815; B21D 26/033; B21D 53/06; B21D 39/04;
(Continued)

(56) References Cited

U.S. PATENT DOCUMENTS 4,260,869 A 4/1981 Slavens et al.
4,838,412 A 6/1989 Backman
(Continued)

FOREIGN PATENT DOCUMENTS

CN 108787799 A 11/2018
EP 1124749 B1 3/2004
(Continued)

OTHER PUBLICATIONS

International Search Report from International Patent Application No. PCT/US2020/035819 dated Aug. 11, 2020, 1 page.
(Continued)

*Primary Examiner* — Victor L MacArthur
(74) *Attorney, Agent, or Firm* — Klintworth & Rozenblat IP LLP

(57) ABSTRACT

A rail segment for a stairlift and its method of formation are provided. The rail segment includes an elongate tube made of a first material, the tube comprising a first end, a second end, and a longitudinal retaining slot extending from the first end to the second end; a rack made of a second material, the rack comprising a first end and a second end, wherein the rack is held within the retaining slot; and anchor securing the rack within the retaining slot to the tube at or adjacent to ends of the tube.

8 Claims, 11 Drawing Sheets

(58) Field of Classification Search
CPC ..... B21D 22/025; B21D 53/08; B21D 28/28; B21D 22/105; B21D 5/015; B21D 11/14; B21D 39/046; B21D 7/00; B21D 22/125; B21D 17/04; B23P 15/14; F16H 55/26; A61G 5/061
See application file for complete search history.

(56) References Cited

U.S. PATENT DOCUMENTS

| | | | | |
|---|---|---|---|---|
| 4,904,916 | A | 2/1990 | Glaske et al. | |
| 5,052,521 | A | 10/1991 | Wendt et al. | |
| 5,235,917 | A | 8/1993 | Luck et al. | |
| 5,676,061 | A | 10/1997 | Loomer | |
| 6,082,496 | A | 7/2000 | Bovis et al. | |
| 6,155,382 | A | 12/2000 | Duijnstee | |
| 6,360,673 | B1 | 3/2002 | Herrin et al. | |
| 6,435,308 | B2 | 8/2002 | Grass | |
| 6,622,637 | B2 | 9/2003 | Cummins | |
| 6,755,136 | B2 | 6/2004 | Jenkins | |
| 6,761,250 | B1 | 7/2004 | Szentisvany et al. | |
| 7,145,433 | B2 | 12/2006 | Gerstenkorn | |
| 7,296,659 | B2 | 11/2007 | Carlsen | |
| 7,322,461 | B2 | 1/2008 | Szentistvany et al. | |
| 8,360,336 | B2 * | 1/2013 | Luckett | F16H 55/26 238/123 |
| 8,485,317 | B2 | 7/2013 | Gerstenkorn et al. | |
| 8,607,936 | B2 | 12/2013 | Szentistvany et al. | |
| 8,660,565 | B2 | 2/2014 | Hall | |
| 9,016,437 | B2 | 4/2015 | DiGiovanni et al. | |
| 9,338,617 | B2 | 5/2016 | Douglas et al. | |
| 9,457,992 | B2 | 10/2016 | Ooms | |
| 9,751,724 | B2 | 9/2017 | Ooms | |
| 9,751,725 | B2 | 9/2017 | Hall et al. | |
| 9,850,093 | B2 | 12/2017 | DePaola et al. | |
| 9,908,745 | B2 * | 3/2018 | De Kroon | B66B 9/08 |
| 10,011,462 | B2 | 7/2018 | Ooms et al. | |
| 10,118,797 | B2 | 11/2018 | Keser | |
| 10,224,768 | B2 | 3/2019 | Zanotti | |
| 10,625,981 | B2 | 4/2020 | Rosenthal | |
| 11,560,290 | B2 | 1/2023 | Lodi | |
| 2002/0011383 | A1 | 1/2002 | Grass | |
| 2004/0104078 | A1 | 6/2004 | Szentistvany et al. | |
| 2004/0255709 | A1 | 12/2004 | Reitberger | |
| 2005/0177288 | A1 | 4/2005 | Sullivan et al. | |
| 2008/0271953 | A1 | 11/2008 | Vroegindeweij | |
| 2010/0064835 | A1 | 3/2010 | Luckett | |
| 2010/0101894 | A1 | 4/2010 | Szentistvany et al. | |
| 2011/0024237 | A1 | 2/2011 | Vroegindeweij | |
| 2011/0278096 | A1 | 11/2011 | Kentenich et al. | |
| 2012/0048652 | A1 | 3/2012 | DiGiovanni et al. | |
| 2014/0083801 | A1 | 3/2014 | Vroegindeweij et al. | |
| 2015/0375965 | A1 | 12/2015 | Awerbuch et al. | |
| 2016/0236906 | A1 * | 8/2016 | Horton | B66B 9/0846 |
| 2016/0268805 | A1 | 9/2016 | Finn et al. | |
| 2017/0001837 | A1 | 1/2017 | Hall et al. | |
| 2017/0144860 | A1 | 5/2017 | Colenutt | |
| 2017/0158464 | A1 * | 6/2017 | De Kroon | B66B 9/0815 |
| 2017/0233223 | A1 | 8/2017 | Hoedjes | |
| 2017/0247227 | A1 | 8/2017 | Rosenthal | |
| 2019/0047825 | A1 | 2/2019 | Jakes et al. | |
| 2020/0239282 | A1 * | 7/2020 | Lodi | B66B 9/0815 |

FOREIGN PATENT DOCUMENTS

| | | | |
|---|---|---|---|
| EP | 3215450 | B1 | 11/2015 |
| GB | 2367807 | A | 4/2002 |
| GB | 2551817 | A | 1/2018 |
| KR | 2001-0055394 | A | 7/2001 |
| WO | 2000/23371 | A1 | 4/2000 |
| WO | 2018/002573 | A1 | 1/2016 |
| WO | 2016/072849 | A1 | 5/2016 |

OTHER PUBLICATIONS

English machine translation of CN 108787799.
English machine translation of KR2001-0055394.

* cited by examiner

STAIRLIFT RAIL AND METHOD OF FORMING SAME

RELATED APPLICATIONS

This application claims the domestic benefit of U.S. Provisional Application Ser. No. 62/855,119 filed on May 31, 2019 and U.S. Provisional Application Ser. No. 62/886,620 filed on Aug. 14, 2019.

FIELD OF THE DISCLOSURE

The disclosure relates to a low-profile rail for a stairlift and the method forming same.

BACKGROUND

Stairlifts (also referred to as chair lifts, stairway elevators, and other, similar names) transport people and/or other cargo up and down inclined paths such as stairways. Stairlifts include a rail and a carriage. The carriage is carried by the rail and movable along the rail.

The carriage includes a frame which may include rollers which ride on the rail, a load support attached to the frame and supporting a load, such as a chair or wheelchair platform, and a carriage drive attached to the frame to drive the frame and load support along the rail. The carriage drive may include a motor and a rack and pinion, screws, chains, cables, belts, and the like driven by the motor to cause the carriage and its associated load support to move along the rail. The load support is rotatably connected to the frame by a rotation device, such that load support rotates about a horizontal axis relative to the carriage. A control unit controls the rotation device, such that the load support is positioned in a desired orientation relative to a horizontal plane. The rotation device includes a motor and a rotator, where the motor is operatively connected to the load support via the rotator to cause rotation of the load support relative to the carriage about the horizontal axis.

The rail is mounted adjacent to or on the stairs and the carriage is attached to the rail. A person seated on the load support or cargo loaded on the load support may be moved up or down the stairway along the rail. The rails may be straight or curved.

Adapting the rail to a particular stairway configuration often requires rails having a wide range of shapes to navigate the person seated on the chair lift over and around stair landings, changes in stair directions or around spiral shaped staircases, while maintaining close proximity to the wall supporting the rail, which demands inward and outward curves having various radii. This has led to the custom-manufacturing of a large number of custom-made rail sections, which has added considerably to the overall cost of, and pre-planning for, the installation.

While bending rails into various shapes demands use of a malleable material for manufacture of the rails, the teeth in the rack portion of the rail need to retain their shape and gap distances between teeth despite the forces exerted on the teeth by the pinion of the carriage drive. This has resulted in compromises between the malleability of the rail and the malleability of the teeth in the rack.

These and other problems are solved by the invention as described below.

SUMMARY OF THE INVENTION

One aspect of the invention is a rail segment for a stairlift comprising a tube having an elongated shape made of a first material, the tube comprising a first end, a second end, and a slot extending in a longitudinal direction from the first end to the second end; a rack made of a second material, the rack comprising a first end and a second end, wherein the rack has a shape which fits within the slot; a first anchor securing the rack within the slot at, or adjacent to, the first end of the tube; and a second anchor securing the rack within the slot at, or adjacent to, the second end of the tube.

Another aspect of the invention is a rail for a stairlift comprising a first rail segment and a second rail segment, wherein each rail segment comprises a tube having an elongate shape made of a first material, the tube comprising a first end, a second end, and a slot extending in the longitudinal direction from the first end to the second end, a rack made of a second material, the rack comprising a first end and a second end, wherein the rack has a shape which fits within the slot, a first anchor securing the rack within the slot at, or adjacent to, the first end of the tube, and a second anchor securing the rack within the slot at, or adjacent to, the second end of the tube, wherein the first end of the tube of the first rail segment abuts the second end of the tube of the second rail segment; a bracket links the first end of the tube of the first rail segment and the second end of the tube of the second rail segment; and a plurality of anchors secure the bracket to the tube of the first rail segment and to the tube of the second rail segment.

A further aspect of the invention is a method of manufacturing a curved rail segment for use in a stairlift rail system, the method comprising: providing a straight tube having an elongate shape comprising a first end, a second end, and a slot extending from the first end to the second end, wherein the tube is made of a first material; providing a rack having an elongate shape comprising a first end, a second end, a base and a plurality of teeth extending from the base, the rack being made of a second material which is different from the first material; inserting the rack into the slot; anchoring the first end of the rack at, or adjacent to, the first end of the tube; bending and/or twisting the anchored rack and tube; and anchoring the second end of the rack at, or adjacent to, the second end of the tube.

A further aspect of the invention is a kit for manufacturing a curved rail segment for use in a stairlift rail system, the kit comprising: a plurality of rail segments, wherein each rail segment comprises a tube having an elongate shape made of a first material, the tube comprising a first end, a second end, and a slot extending in the longitudinal direction from the first end to the second end, a rack made of a second material, the rack comprising a first end and a second end, wherein the rack has a shape which fits within the slot of each tube and has a length greater than the length of one or more of the plurality of rail segments, a plurality of anchors for securing the rack within the slot and a plurality of brackets for linking the plurality of rail segments to each other end-to-end.

BRIEF DESCRIPTION OF THE DRAWINGS

Many aspects of the disclosure can be better understood with reference to the following drawings. While several implementations are described in connection with these drawings, the disclosure is not limited to the implementations disclosed herein. On the contrary, the intent is to cover all alternatives, modifications, and equivalents.

DETAILED DESCRIPTION

Figure 1:
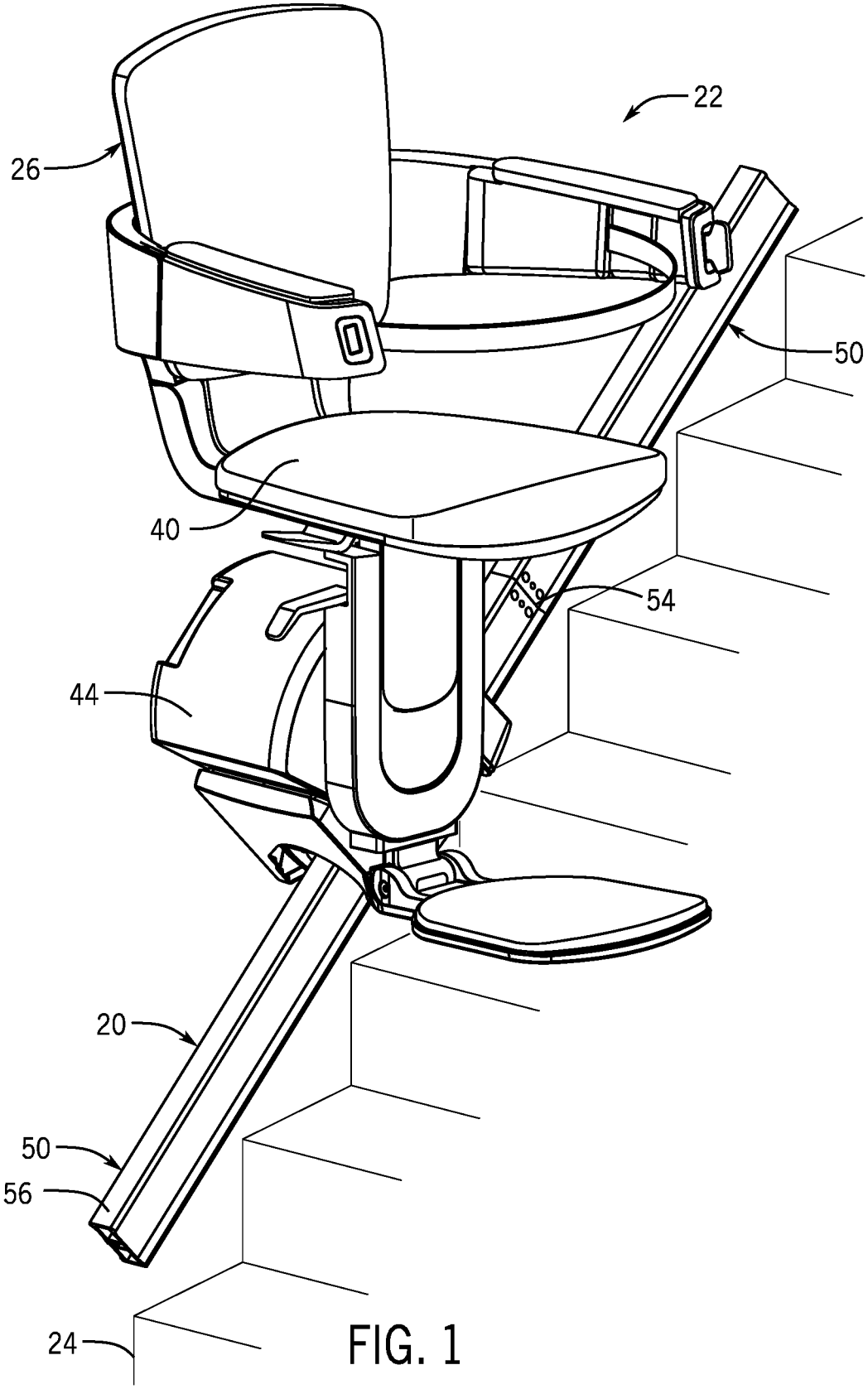
FIG. 1 illustrates a rail of the present disclosure and an example of a stairlift with which the rail can be used.

While the disclosure may be susceptible to embodiment in different forms, there is shown in the drawings, and herein will be described in detail, a specific embodiment with the understanding that the present disclosure is to be considered an exemplification of the principles of the disclosure, and is not intended to limit the disclosure to that as illustrated and described herein. Therefore, unless otherwise noted, features disclosed herein may be combined together to form additional combinations that were not otherwise shown for purposes of brevity. It will be further appreciated that in some embodiments, one or more elements illustrated by way of example in a drawing(s) may be eliminated and/or substituted with alternative elements within the scope of the disclosure.

Definitions

The term "tube" means a hollow profile having a length greater than its maximum cross-section. The tube preferably has an hourglass-shaped cross-section.

The term "slot" means an elongated groove or aperture having a length corresponding to the length of the tube for accepting a portion of a rack suitable for engaging the slot. The slot is preferably has a cross-sectional profile shape having retaining surfaces capable of retaining the rack on the tube by engaging with a corresponding cross-sectional profile shape of the rack along the length of the slot. In a particular embodiment, the cross-sectional profile shape is an inward outline of a T-shape.

The term "rack" means a profile having an elongate shape having a length and a plurality of protrusions extending from a surface thereof, wherein the protrusions occur at regular intervals over the entire length of the rack for engagement with a pinion. The rack preferably has a cross-sectional profile shape along the length of the rack opposite the surface having a plurality of protrusions corresponding to the shape of the slot for retaining the rack in the slot. In a preferred embodiment, the cross-sectional profile shape has lateral extensions perpendicular to a longitudinal direction for engaging with the cross-sectional profile of the slot. In a particular embodiment, the cross-sectional shape is T-shaped.

The term "anchor" refers to a device or material capable of fixing the rack to the tube. Examples of anchors include threaded bolts and welds. When the slot is capable of retaining the rack, the anchor may be a threaded bolt and a threaded opening in the tube suitable for screwing the bolt into the tube toward a rack retained in the slot for pressing the rack against the retaining surfaces of the slot.

A rail 20 which forms part of a stairlift 22, and a method forming same are provided. The stairlift 22 is also referred to as a chair lift, stairway elevator, rail elevator, and other similar names. The rail 20 is mounted along a stairway 24 or other stairlift travel path, and the stairlift 22 further includes a carriage 26 mounted on the rail 20 for operation to move a load on the carriage 26 along the rail 20. The stairlift 22 provides smooth transitions through turns, curves, bends and other changes in the rail 20.

The rail 20 may include inclines, declines, various types of curves (including helical twists, turns and vertical elevation angle changes) and/or other changes in direction and/or orientation. Thus, various curves (helical, vertical, horizontal and combinations thereof) must be negotiated by the carriage 26. An angle change transitions the carriage 26 elevationally from one incline/decline angle to another. There are two types of angle changes—"going in" angle changes and "going out" angle changes. A "going in" angle change is an angle change that starts from a steeper angle and transitions to a flatter incline. A "going out" angle change is an angle change that starts from a lower degree and transitions to a higher degree incline. "Turns" transition the carriage 26 around a corner (horizontal bend) in a plan view. There are two primary types of turns and each primary type of turn has a corresponding secondary set. During an "inside turn" a rider's feet swing widely while the rider's back is closer to the turn's pivot point. In general, the rail 20 may be as close as possible to a wall to which the rail 20 is mounted to allow for maximum clearance for ambulatory people in the stairway 24 or other stairlift travel path. Inside turns often rotate the rider 90° or 180° in the plan view. A "helical turn" introduces an incline or elevation change while turning corners in connection with inside and outside turns (similar to a corkscrew or coil spring). A gooseneck or drop-nose configuration can also be provided which has a going in angle change, with an extremely steep start angle (e.g., vertical) that transitions to the incline of the stairway 24 or other stairlift travel path. The gooseneck or drop-nose configuration provides a low cargo carrying position height position relative to a floor at a base of the stairway 24 or other stairlift travel path, and a short extension away from a first step riser of the stairway 24 or other stairlift travel path.

The carriage 26 includes a frame 28 which may include rotatable rollers 30, 32, 34, 36, 38 mounted thereon and which ride on the rail 20, a load support 40 attached to the frame 28 and supporting the load, and a motor driven toothed gear 42 rotatably attached to the frame 28 and engaged with the rail 20 to drive the carriage 26 along the rail 20. The load may be, for example, an individual rider and/or cargo. The frame 28, with the exception of where the rollers 30, 32, 34, 36, 38 contact the rail 20, and the motor driven toothed gear 42 may be covered by a shroud 44.

The load support 40 is rotatably connected to the frame 28 by a rotation device (not shown) which rotates the load support 40 about a horizontal axis relative to the frame 28 to maintain the load in an upright position as the carriage 26 traverses along the rail 20.

The rail 20 includes one or more rail segments 50 that fit within a given stairway 24 or other stairlift travel path. The one or more rail segments 50 can be straight, or can be curved in one or more ways, for example, being twisted, horizontally curved, vertically curved, and combinations thereof. Each rail segment 50 has a first end 50*a*, an opposite second end 50*b*, and a longitudinal central axis 52 that extends between the ends 50*a*, 50*b*. A length of the rail segment 50 is defined between the ends 50*a*, 50*b*. When more than one rail segment 50 is provided, the rails segments 50 are connected at adjacent ends 50*a*, 50*b* at a joint 54.

One rail segment 50 and its method of formation is described, with the understanding that the other rail segments 50 are identically formed.

The rail segment 50 includes an elongated tube 56 and an elongated rack 58 carried on the tube 56. The rack 58 is separately manufactured from the tube 56 and attached thereto as described herein.

The tube 56 is formed from a durable, yet suitably malleable material. In some implementations, the tube 56 is formed from aluminum or an aluminum alloy.

Figure 2:
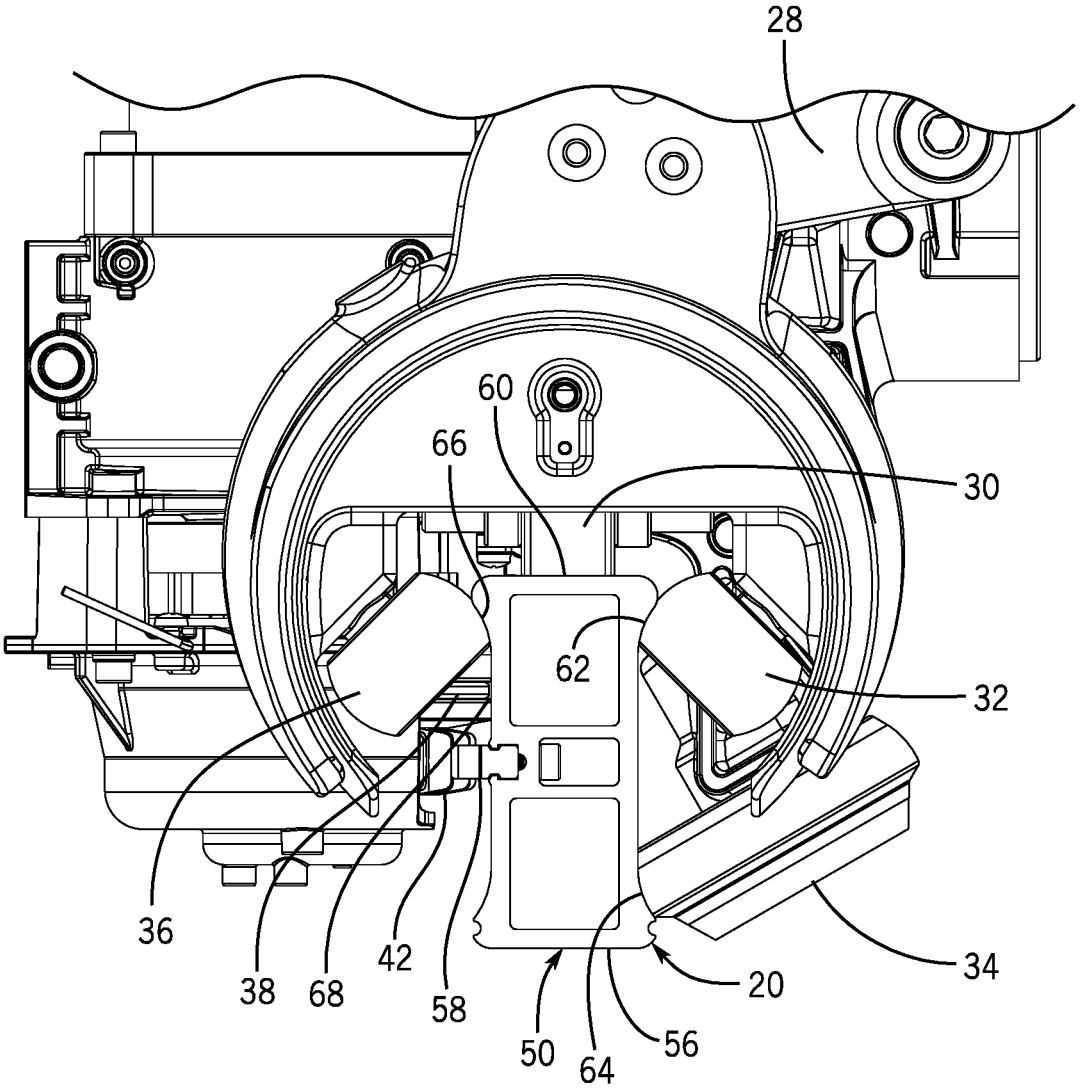
FIG. 2 illustrates a cross-sectional view of the rail and the example of the stairlift with which the rail can be used.
Figure 3:
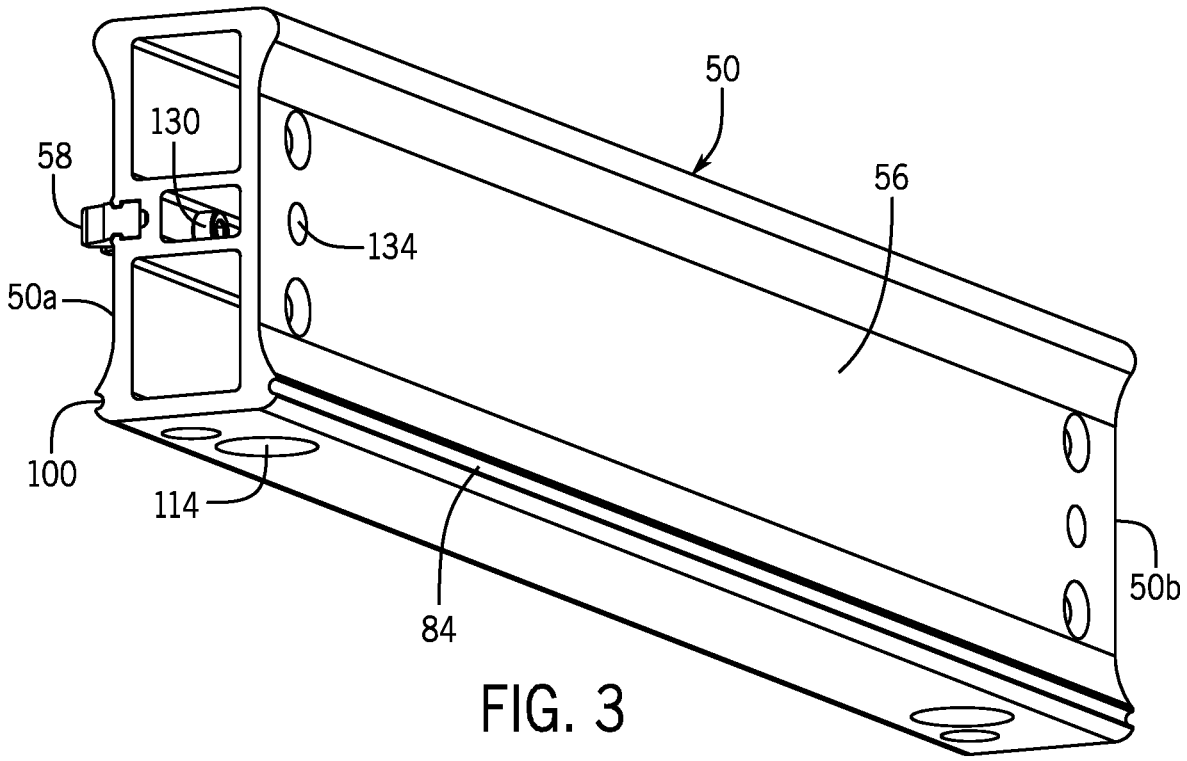
FIGS. 3 and 4 are front perspective views of a rail segment of the rail.
Figure 4:
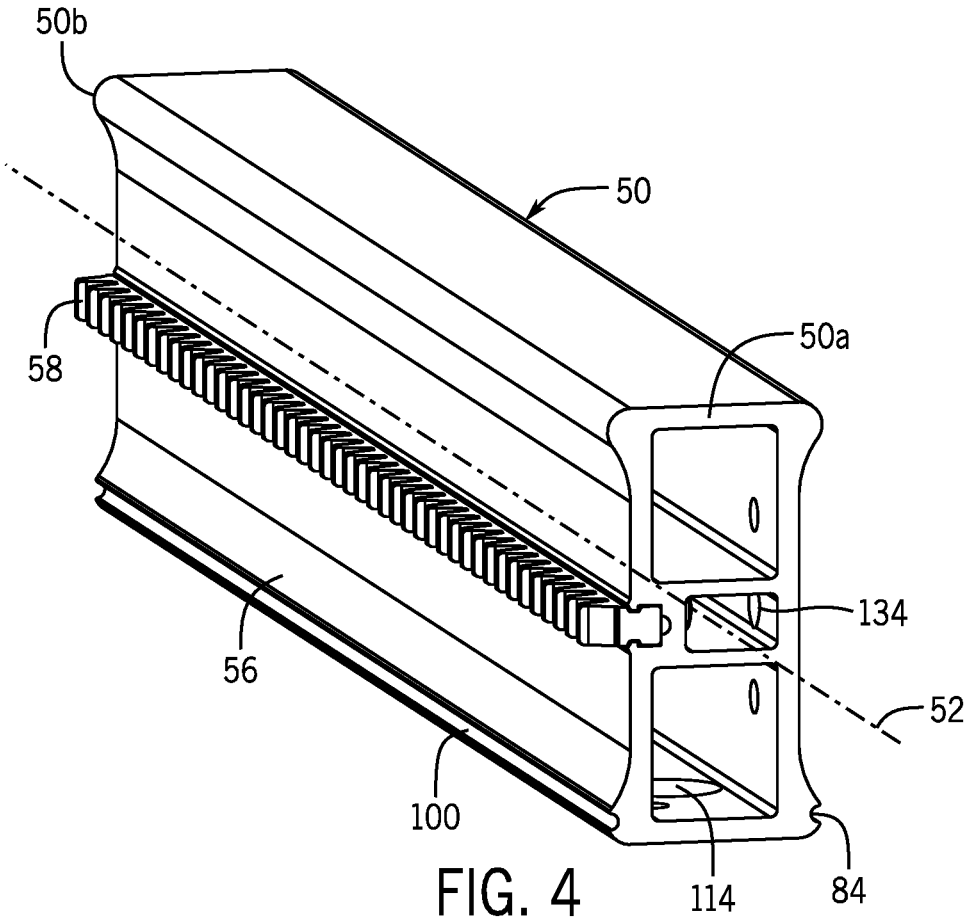
Figure 5:
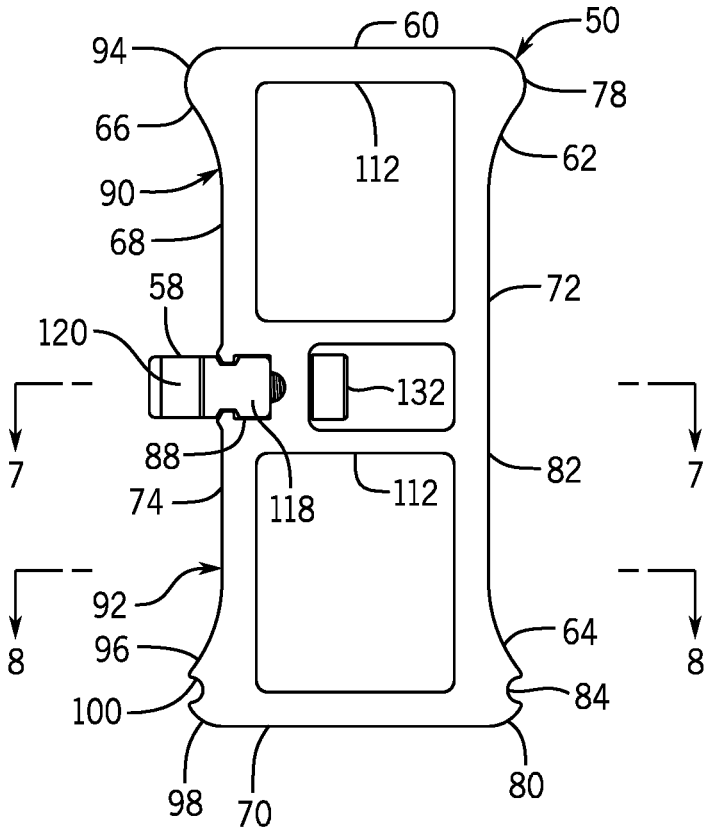
FIG. 5 is a cross-sectional view of the rail segment.
Figure 6:
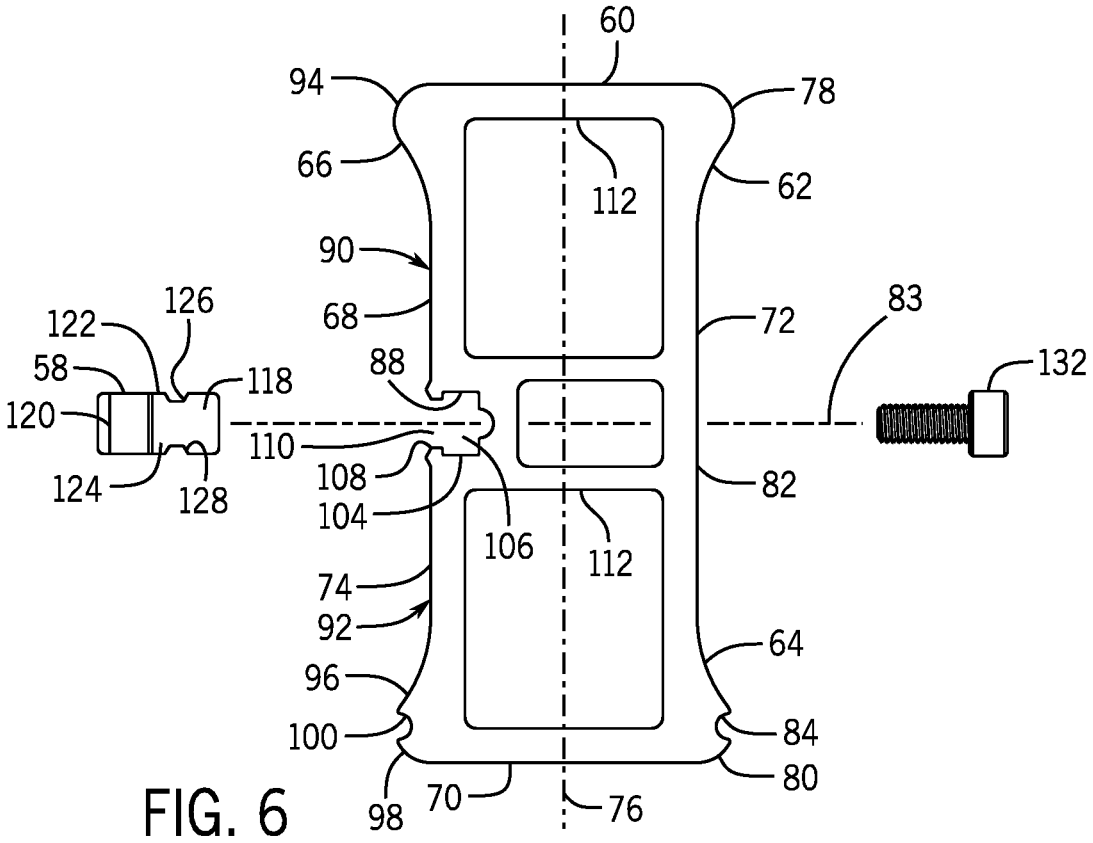
FIG. 6 is an exploded cross-sectional view of the rail segment.
Figure 7:
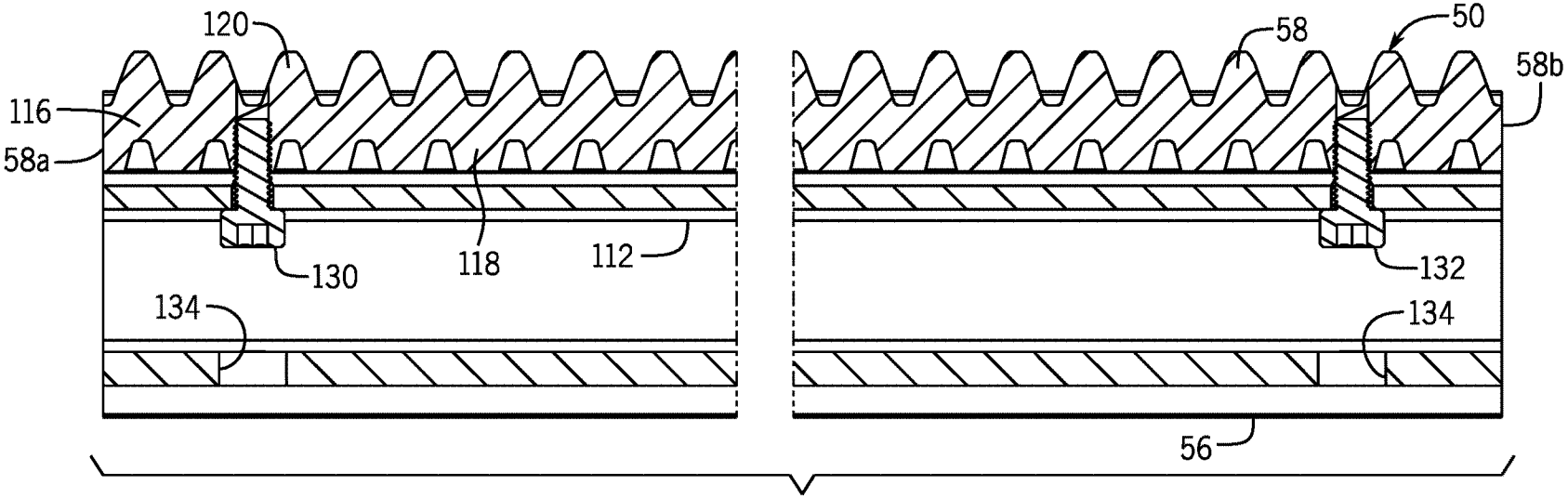
FIG. 7 is a cross-sectional view of the rail segment along the line 7-7 of FIG. 5.
Figure 8:
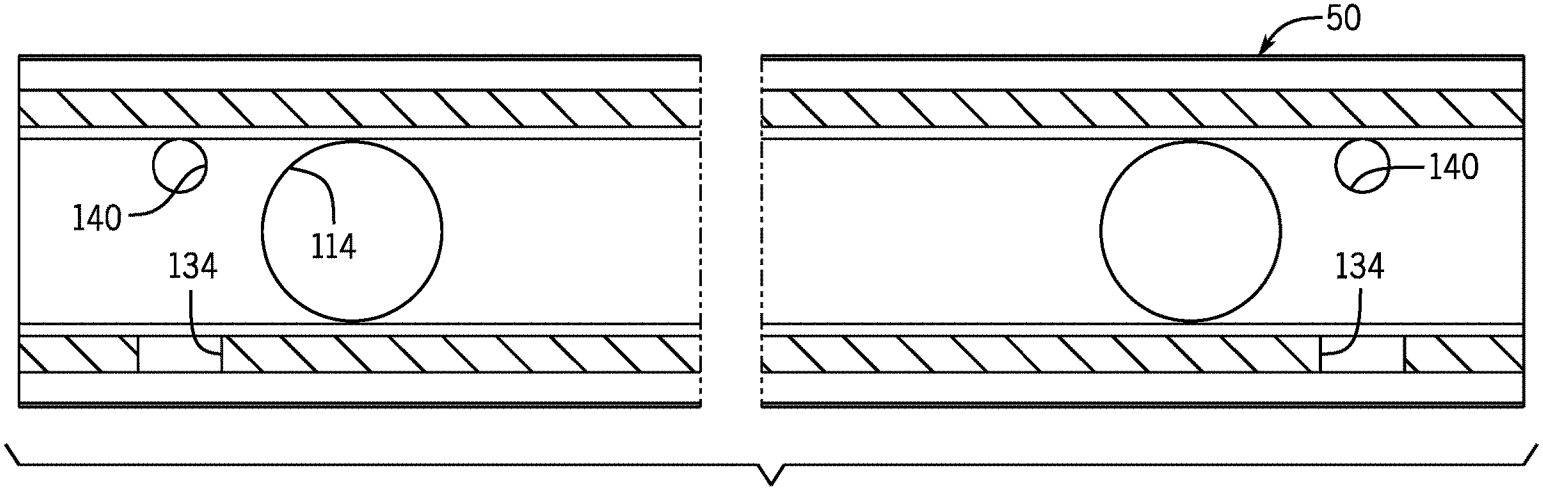
FIG. 8 is a cross-sectional view of the rail segment along the line 8-8 of FIG. 5.
Figure 15:
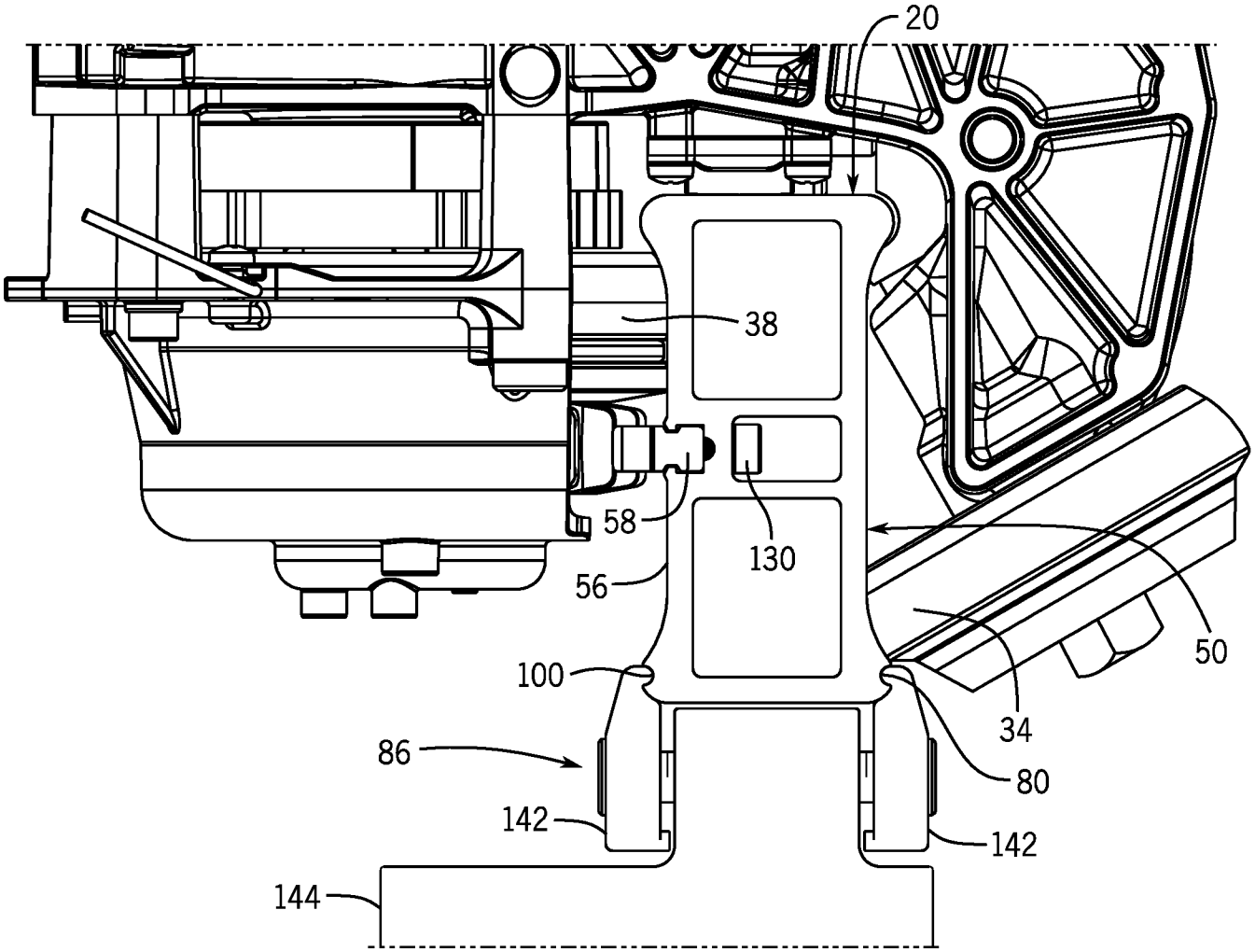
FIG. 15 is a cross-sectional view of the rail segment and the example of the stairlift with which the rail can be used, and showing the rail segment attached to a mount.

When the tube 56 is in an unbent condition or untwisted condition, the tube 56 has a constant cross-sectional shape along its length from a first end 56*a* to a second end 56*b* thereof. In the unbent condition or untwisted condition, the tube 56 preferably has an hourglass cross-sectional shape, as shown in FIGS. 2-5. The cross-sectional shape of the tube 56 provides a plurality of surfaces 60, 62, 64, 66, 68 against which the rollers 30, 32, 34, 36 of the carriage 26 engage, for example as shown in FIGS. 2 and 15. The generally hourglass cross-section of the tube 56 provides a stable base on which carriage 26 operates. The generally hourglass cross-section shape of the tube 56 provides inherent torsional resistance because of its shape when compared to round tube systems, which need additional parts (for example, welded guides for the entire length of the rail) to take up the torsion in the system, resulting in larger beams (which can occupy valuable space in staircases and other installation locations).

The following cross-sectional shape is described when the tube 56 is in the unbent condition and untwisted condition. The tube 56 has a planar top surface 60 forming a first roller engagement surface and a bottom surface 70. In one embodiment, the bottom surface 70 is planar and is parallel to the top surface 60. An outer side surface 72 extends between the top and bottom surfaces 60, 70 and faces away from the wall when the rail segment 50 is mounted on the stairway 24. An inner side surface 74 extends between the top and bottom surfaces 60, 70 and faces the wall when the rail segment 50 is mounted on the stairway 24. A vertical centerline 76 is defined between the top and bottom surfaces 60, 70 and splits the tube 56 into halves with the outer side surface 72 on one side of the centerline 76 and the inner side surface 74 on the other side of the centerline 76.

The outer side surface 72 has the surface 62 which is curved and extends along a radius line, an upper curved surface 78 that extends between an upper end of the surface 62 and the top surface 60, the surface 64 which is curved and extends along a radius line, a lower curved surface 80 that extends between a lower end of the surface 64 and the bottom surface 70, and a planar side surface 82 which extends between a lower end of the surface 62 and an upper end of the surface 64. The surfaces 62, 64 may have the same radius. The surface 62 provides a second roller engagement surface. The surface 64 provides a third roller engagement surface. A groove 84 may be formed in the lower curved surface 80 and extends longitudinally along the rail segment 50 to permit mounting of the rail segment 50 on a stairway 24 or other stairlift travel path using a suitable mount 86. A horizontal centerline 83 is defined between the surface 68, 82 and splits the tube 56 into halves and is perpendicular to the centerline 76.

In one embodiment, the inner side surface 74 is the mirror image of the outer side surface 72 with the exception of a longitudinal retaining slot 88 that extends the entire length of the tube 56 from the first end 56*a* to the second end 56*b* thereof and divides the inner side surface 74 into an upper portion 90 and a lower portion 92.

Accordingly, the inner side surface 74 has the surface 66 which is curved and extends along a radius line, an upper curved surface 94 that extends between an upper end of the surface 66 and the top surface 60, a lower curved surface 96 which is curved and extends along a radius line, a lower curved surface 98 that extends between a lower end of the surface 96 and the bottom surface 70, and the surface 68 which is planar, forms a side surface, and extends between a lower end of the surface 66 and an upper end of the surface 98. The surfaces 66, 96 may have the same radius, and may have the same radius as surfaces 62, 64. The surface 66 provides a fourth roller engagement surface. The surface 68 provides a fifth roller engagement surface. In an embodiment, the surface 68 in the upper portion 90 provides the fifth roller engagement. In an embodiment, the surface 68 in the lower portion 92 provides the fifth roller engagement. A groove 100 may be formed in the lower curved surface 98 and extends longitudinally along the rail segment 50 to permit mounting of the rail segment 50 on a stairway 24 or other stairlift travel path using a suitable mount 86. In an embodiment, any surface of the tube 56 that does not form a roller engagement surface can take shapes other than those specifically shown.

In an embodiment, the longitudinal retaining slot 88 is at the midpoint of the inner side surface 74 such that the inner side surface 74 is divided into an upper half and a lower half. In an embodiment, the longitudinal retaining slot 88 is offset from the midpoint of the inner side surface 74 such that the upper portion and the lower portions are unequal. As shown, the retaining slot 88 includes walls 104 forming an enlarged longitudinally extending cavity section 106 which is connected to the inner side surface 74 by walls 108 forming a longitudinally extending necked-down section 110, such that a generally T-shaped slot is formed.

The planar top surface 60 accommodates the use of a roller 30 having a cylindrical outer profile as shown in FIG. 2. The radiused surfaces 62, 64, 66 accommodate the use of rollers 32, 34, 36 having spherical outer profiles as shown in FIGS. 2 and 15. The surfaces 62, 64, 66 are radiused at a corresponding radii to that of the spherical surface outer profiles of the rollers 32, 34, 36. The planar surface 68 accommodates the use of a roller 38 having a cylindrical outer profile as shown in FIG. 2.

Internal longitudinally extending cavities or channels 112 may also be provided in the tube 56 to permit deployment of wiring and/or other apparatus to assist in operating the stairlift 22. The cavities or channels 112 also assist in reducing the weight of the rail 20. Wiring holes 114 may also be provided to allow for wiring and/or other apparatus to be threaded through a given rail segment 50 and into the cavities or channels 112.

The rack 58 is formed from a durable material and may be a more rigid material from that which the tube 56 is formed, but in some embodiments, is more robust than the tube 56. In some implementations, the rack 58 is formed from steel.

When the rack 58 is in an unbent condition or untwisted condition, the rack 58 has a constant cross-sectional shape along its length. In the unbent condition or untwisted condition, the rack 58 has a longitudinally extending base section 116 which extends from a first end 58*a* of the rack 58 to a second end 58*b* of the rack 58. The base section 116 is generally rectangular in cross-section. A plurality of spaced apart protrusions 118 extend from a first side of the base section 116, and a plurality of spaced apart teeth 120 extend from a second side of the base section 116. Side surfaces 122, 124 extend between the protrusions 118 and the teeth 120. The side surfaces 122, 124 are planar with the exception of a longitudinally extending groove 126, 128 in each side surface 122, 124; the grooves 126, 128 may align with each other. The grooves 126, 128 are slightly larger than the walls 108 forming the necked-down section 110.

The rack 58 is mated with the tube 56 by the protrusions 118 being seated within the enlarged cavity section 106, and the longitudinally extending grooves 126, 128 being engaged with the walls 108 forming the necked-down section 110 of the retaining slot 88. The engagement of the longitudinally extending grooves 126, 128 being engaged with the necked-down section 110 prevents the rack 58 from being pulled outwardly from the inner side surface 74 of the tube 56. As a result, the teeth 120 extend outwardly from the inner side surface 74.

In some embodiments, the rack 58 is secured to the tube 56 by anchors 130, 132 such as screws or welds. In some embodiments, access to/for the anchors 130, 132 are provided through one or more access holes 134 in the tube 56. Anchor 130 secures the first end 58*a* of the rack 58 at or adjacent to the first end 56*a* of the tube 56, and anchor 132 secures the second end 58*b* of the rack 58 at or adjacent to the second end 56*b* of the tube 56.

Where a stairway 24 or other stairlift travel path has been measured in advance, customized rail segments 50 can be fabricated offsite to provide a minimally-intrusive rail 20 that is easily and quickly installed for a stairlift 22 operating in the pre-measured stairway 24 or other stairlift travel path.

Figure 9:
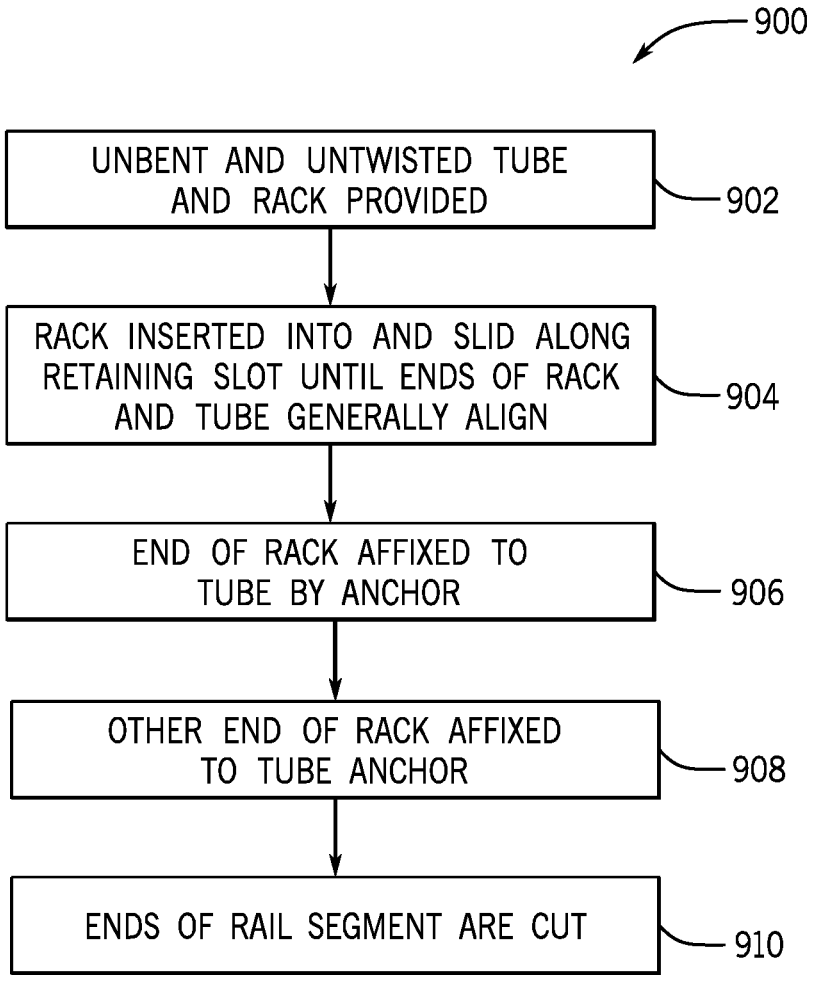
FIG. 9 is a flow diagram illustrating one or more methods of fabricating a straight rail segment.

FIG. 9 provides a flowchart which illustrates the method 900 for fabricating a straight (unbent or untwisted) rail segment 50. At step 902, the tube 56 and the rack 58 are provided in an unbent and untwisted form. At step 904, the first end 58*a* of the rack 58 is inserted through the second end 56*a* of the tube 56 and the rack 58 is slid along the retaining slot 88 with the protrusions 118 seating within in the cavity section 106, and the grooves 126, 128 engaging with the walls 108 forming the necked-down section 110. The rack 58 is slid along the length of the retaining slot 88 until the first end 58*a* of the rack 58 generally aligns with the first end 56*a* of the tube 56. At step 906, the rack 58 is affixed to the tube 56 by the anchor 130, at or adjacent to the first end 56*a* of the tube 56. At step 908, the rack 58 is affixed to the tube 56 by the anchor 132, at or adjacent to the second end 56*b* of the tube 56. Thereafter, at step 910, the ends 50*a*, 50*b* of the rail segment 50 are cut, if necessary, such that the ends 56*a*, 58*a* align with each other, and such that the ends 56*b*, 58*b* align with each other and to ensure proper matching of the pitch of the rack 58 at the intended joint 54 in the rail 20 with the next rail segment 50. In some embodiments, only the end 58*a* and/or end 58*b* of the rack 58 will need to be cut. In some embodiments, both of the ends 56*a*, 58*a* of the tube 56 and the rack 58 and/or both of the ends 56*b*, 58*b* of the tube 56 and the rack 58 will need to be cut. In some embodiments, the ends 56*a*, 58*a* and/or ends 56*b*, 58*b* are cut to be perpendicular to the centerline 76 of the rail segment 50. In other embodiments, the ends 56*a*, 58*a* and/or ends 56*b*, 58*b* are cut to be at an angle relative to the centerline 76 of the rail segment 50 such that the ends 56*a*, 58*a* and/or ends 56*b*, 58*b*. The completed rail segment 50 is then ready for assembly into the rail 20.

Figure 10:
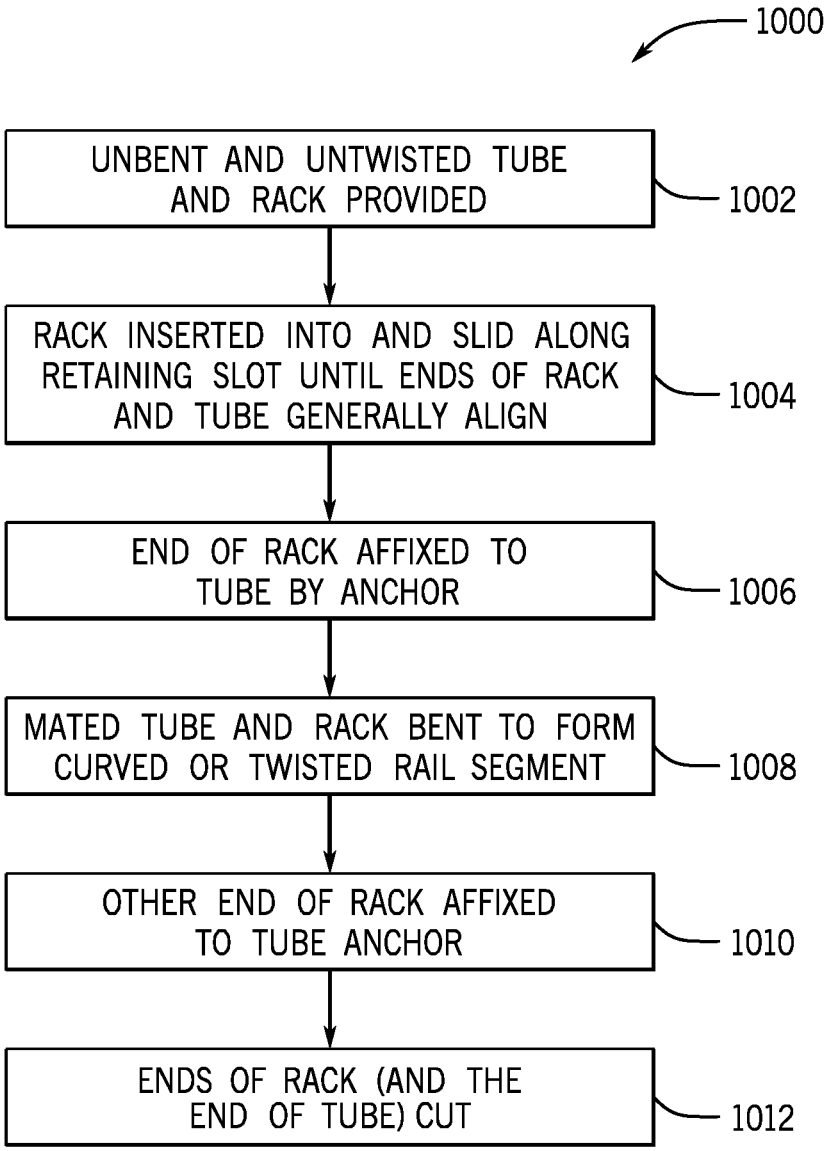
FIG. 10 is a flow diagram illustrating one or more methods of fabricating a curved rail segment.
Figure 11A:
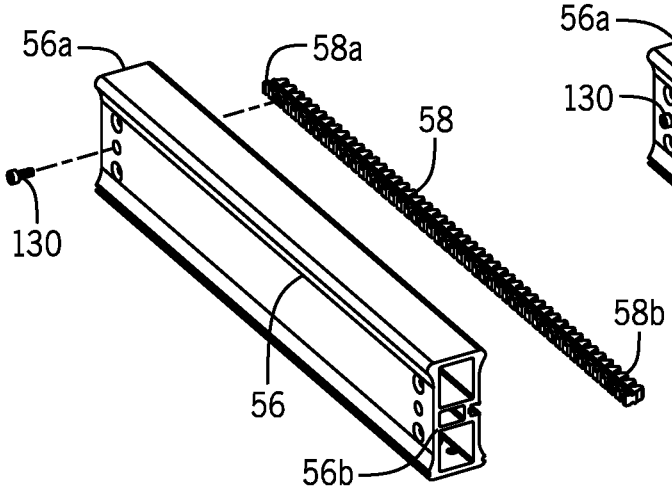
FIGS. 11A-11E illustrate various steps in methods of fabricating the curved rail segment.
Figure 11B:
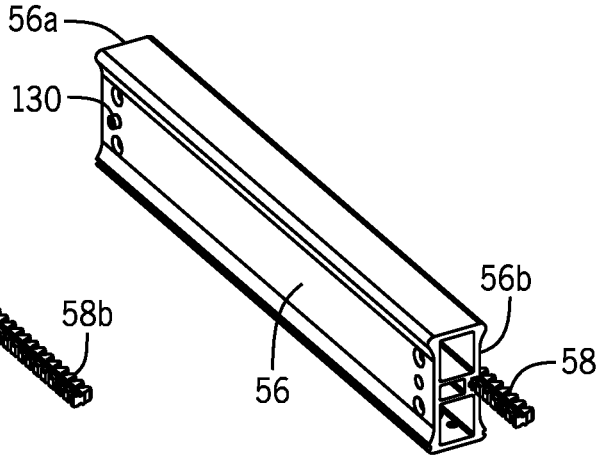
Figure 11C:
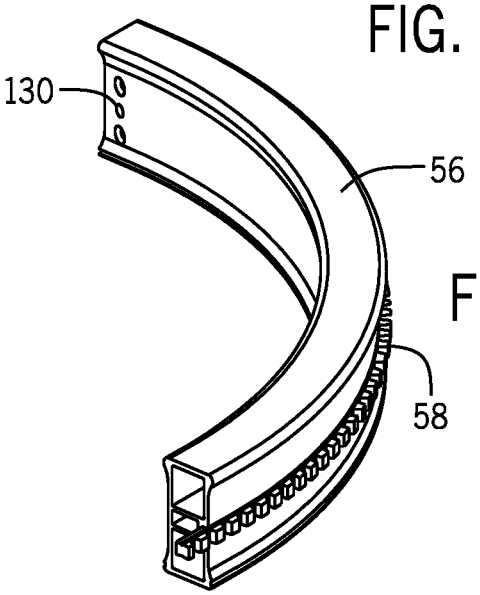
Figure 11D:
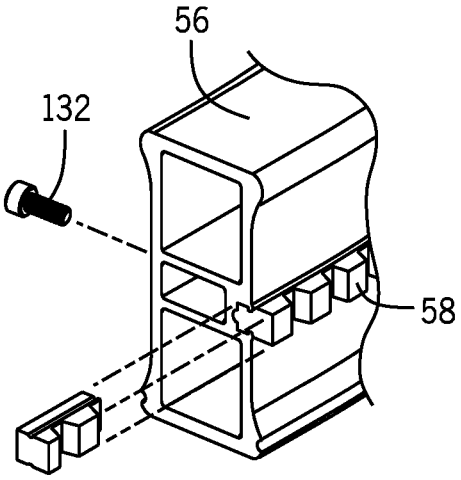
Figure 11E:
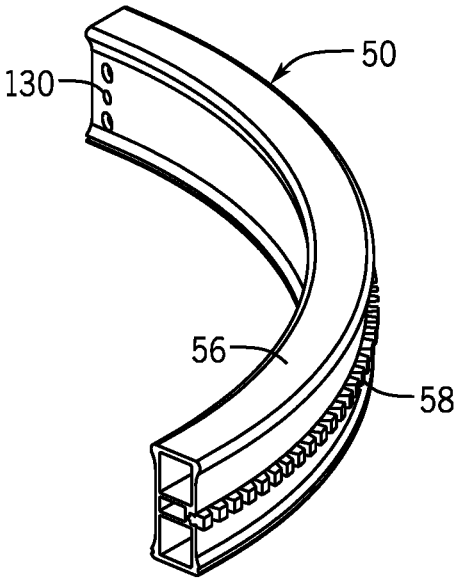

FIG. 10 provides a flowchart which illustrates the method 1000 for fabricating a curved rail segment 50. Some steps covered by the method 1000 of FIG. 10 are illustrated in FIGS. 11A-11E. At step 1002 and as shown in FIG. 11A, the tube 56 and the rack 58 are provided in an unbent and untwisted form. At step 1004 and as shown in FIG. 11B, the first end 58*a* of the rack 58 is inserted through the second end 56*a* of the tube 56 and the rack 58 is slid along the retaining slot 88 with the protrusions 118 seating within in the cavity section 106, and the grooves 126, 128 engaging with the walls 108 forming the necked-down section 110. The rack 58 is slid along the length of the retaining slot 88 until the first end 58*a* of the rack 58 generally aligns with the first end 56*a* of the tube 56. At step 1006 and as shown in FIG. 11B, the rack 58 is affixed to the tube 56 by the anchor 130, at or adjacent to the first end 56*a* of the tube 56. In some embodiments, the first end 58*a* of the rack 58 (and the first end 56*a* of the tube 56) may be cut or trimmed after the anchoring by the anchor 130 to remove any excess rack 58 that extends beyond the first end 56*a* of the tube 56. Cutting or trimming also may be done to ensure proper matching of the pitch of the rack 58 at an intended joint 54 in the rail 20. Thereafter, at step 1008 and as shown in FIG. 11C, the mated tube 56 and rack 58 are bent simultaneously on the horizontal centerline 83 to form a curved or twisted rail segment 50. The mated tube 56 and rack 58 can be bent and/or twisted into a variety of shapes to accommodate angle changes, turns, and gooseneck or drop-nose configurations, one implementation of which is illustrated in FIG. 11C. The anchoring of the mated tube 56 and rack 58 at or adjacent to their first ends 56*a*, 58*a* allows the tube 56 and the rack 58 to bend independently of one another, and yet to bend to a nearly identical shape. Because different materials of different shapes may bend differently, the tube 56 and the rack 58 bend independently, because the materials have different malleability and/or other properties. At step 1010 and as shown in in FIG. 11D, after the rail segment 50 is bent and/or twisted in the desired shape, the second end 58*b* of the rack 58 is anchored to the second end 56*b* of the tube 56 by the anchor 132. The length of the rack 58 used in this method must be sufficiently long to provide adequate length in the finished curved rail segment 50. At step 1012, the second end 58*b* of the rack 58 (and the second end 56*b* of the tube 56) may be cut or trimmed after the anchoring to remove any excess rack 58 that extends beyond the first end 56*a* of the tube 56. Cutting or trimming also may be done to ensure proper matching of the pitch of the rack 58 at an intended joint in the rail 20. The completed rail segment 50 is then ready for assembly into a full rail 20.

Any suitable bending process can be used to create the curved rail segment 50. Freeform bending, and push bending in particular, are non-limiting examples of bending processes that can be employed in some implementations, allowing the straight composite rail segment stick to be shaped kinematically.

Figure 12:
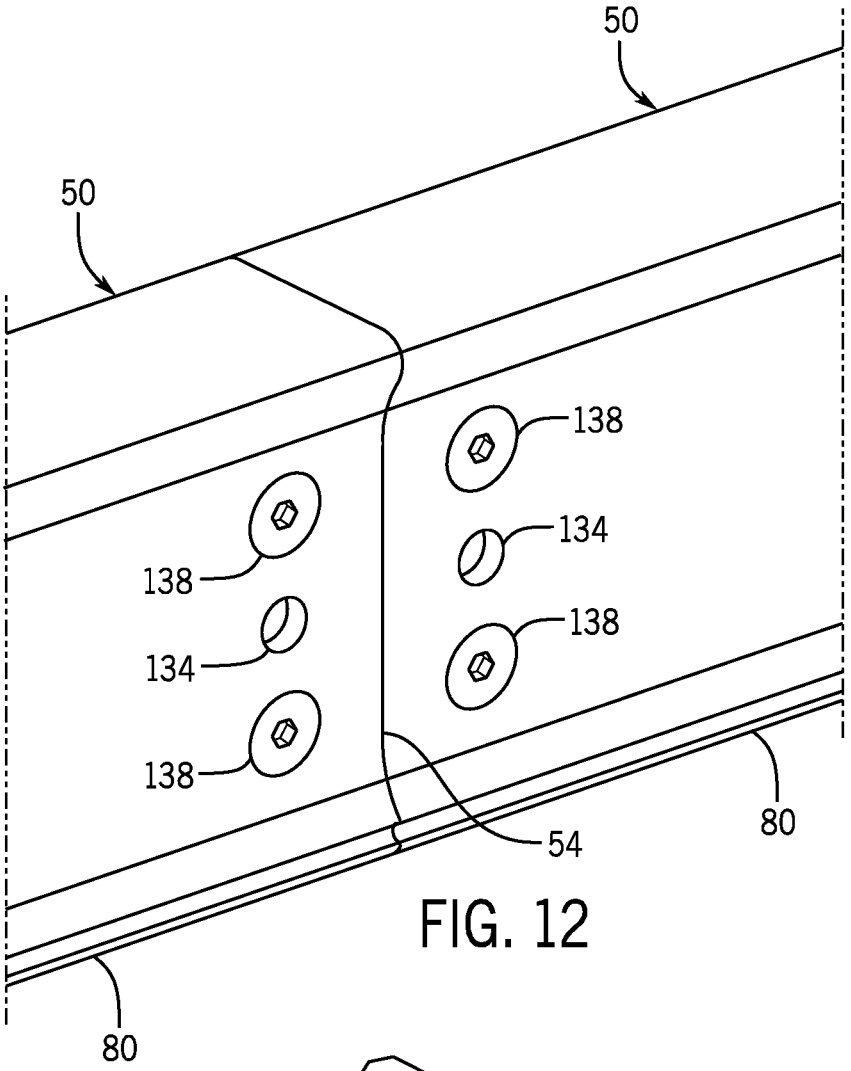
FIG. 12 is a perspective view of two rail segments and showing the joint therebetween.
Figure 13:
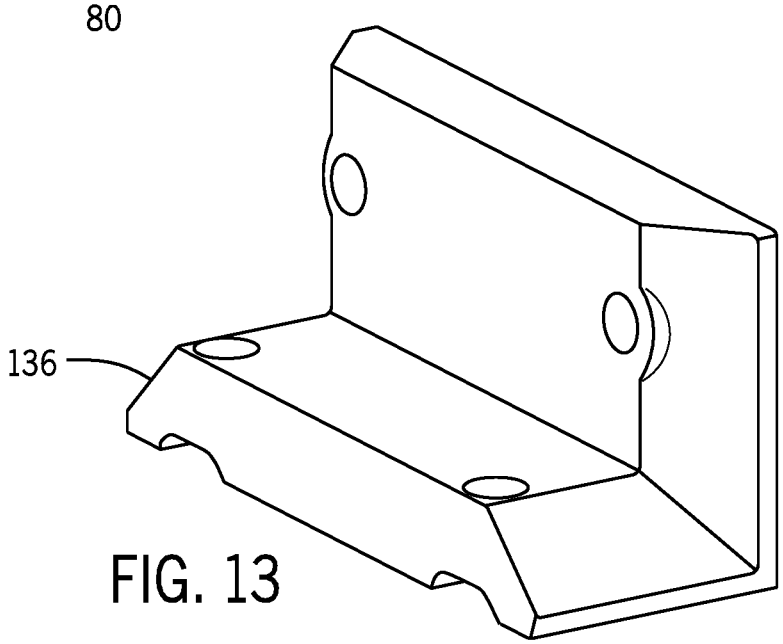
FIG. 13 is a perspective view of a bracket used in the joint of FIG. 12.
Figure 14:
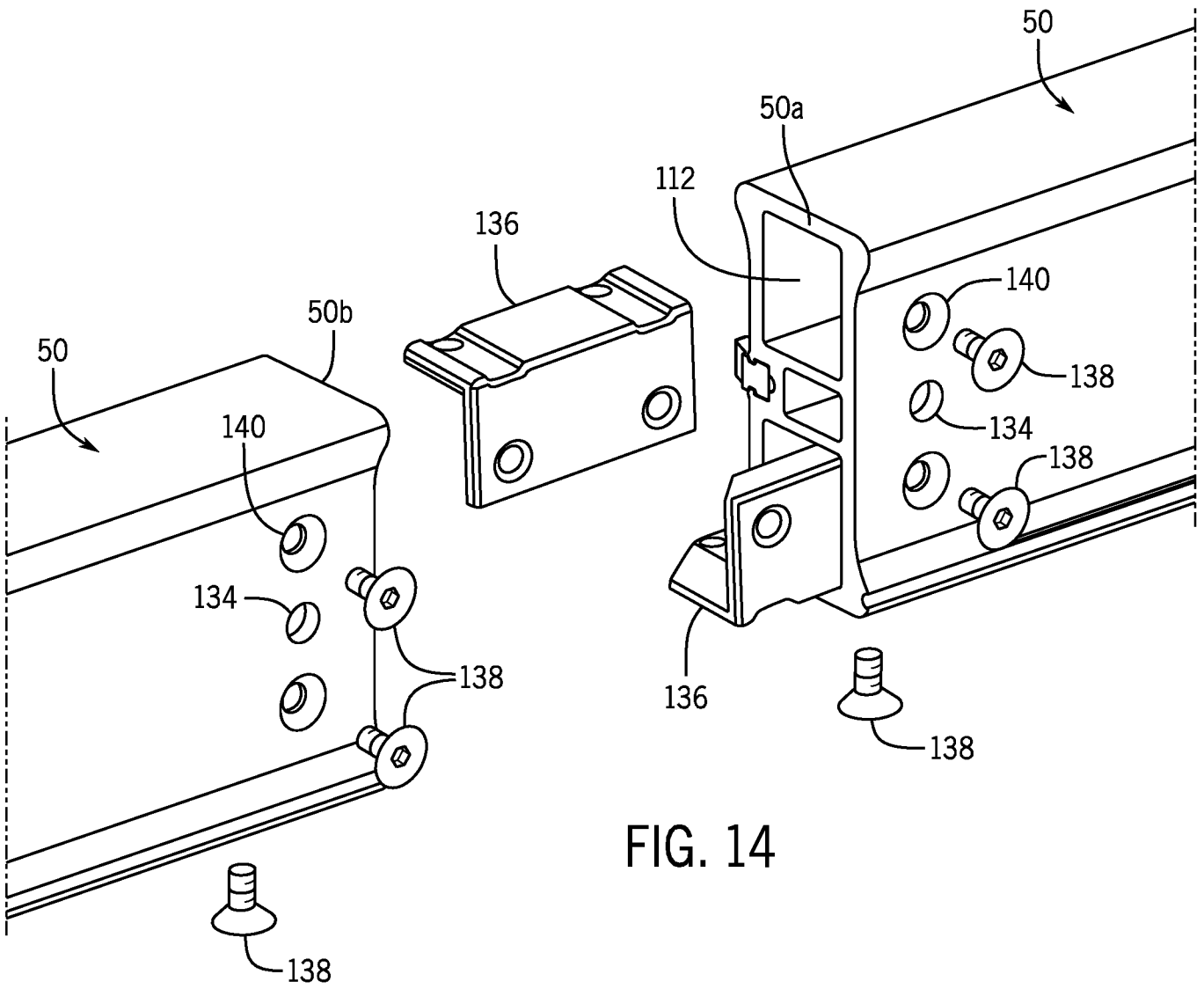
FIG. 14 is an exploded perspective view of the two rail segments and the joint of FIG. 12.

As seen in FIGS. 12-14, the joint 54 is formed between two adjacent rail segments 50. The first end 50*a* of the one rail segment 50 abuts against the second end 50*b* of the other rail segment 50 and are mated together by the joint 54.

In an embodiment, the joint 54 may be simultaneously secured and reinforced by blocks 136, such as L-shaped brackets. One or more blocks 136 are secured in place in the cavities or channels 112 in each rail segment 50 to link the tube 56 of the one rail segment 50 to the tube 56 of the adjacent rail segment 50. Anchors 138, such as screws, welds and the like, are used to attach the blocks 136 to the adjacent tubes 56 through holes 140 in the tube 56. In some embodiments, the blocks 136 may also reinforce and/or rigidize the abutment of the adjacent tubes 56.

In an embodiment, the mount 86 includes cleats 142 and a mounting bracket(s) 144 which mount the rail segment 50 to the stairway 24 as shown in FIG. 15. The mounting bracket(s) 144 may be affixed to a stair, floor or other suitable mounting location. The cleat 142 can include opposing jaws that are held in a clamping orientation and which engage the grooves 84, 100 using one or more screws or other securements.

Many modifications and other embodiments of the disclosure set forth herein will come to mind to one skilled in the art to which these disclosed embodiments pertain having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the disclosure. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the disclosure. In this regard, for example, different combinations of elements and/or functions than those explicitly described above are also contemplated within the scope of the disclosure. Although specific terms are employed herein, they are used in a generic and descriptive sense only and not for purposes of limitation.

While particular embodiments are illustrated in and described with respect to the drawings, it is envisioned that those skilled in the art may devise various modifications without departing from the spirit and scope of the appended claims. It will therefore be appreciated that the scope of the disclosure and the appended claims is not limited to the specific embodiments illustrated in and discussed with respect to the drawings and that modifications and other embodiments are intended to be included within the scope of the disclosure and appended drawings. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the disclosure and the appended claims.

What is claimed is:

1. A method of manufacturing a rail segment for use in a stairlift rail system, the method comprising:

providing an elongate straight tube comprising a first end, an opposite second end, and a longitudinal retaining slot extending from the first end to the second end, the tube being made of a first material;

providing an elongate rack comprising a first end, a second end, a base and a plurality of teeth extending from the base, the rack being made of a second material which is different from the first material;

inserting the rack into the slot thereby forming a mated rack and tube assembly;

anchoring the first end of the rack at or adjacent to the first end of the tube;

thereafter simultaneously bending and/or twisting the mated rack and tube assembly and thereby forming a curved rail segment; and thereafter anchoring the second end of the rack at or adjacent to the second end of the tube.

2. The method of claim 1, further comprising trimming at least one of the ends of the rack after anchoring.

3. The method of claim 1, wherein bending and/or twisting of the mated rack and tube assembly is performed using freeform bending or push bending.

4. The method of claim 1, wherein the bending and/or twisting of the mated rack and tube assembly is located on a horizontal centerline of the tube.

5. The method of claim 1, wherein the elongate straight tube has a planar upper surface, an opposite lower surface, a first side surface extending between the upper and lower surfaces and a second opposite side surface extending between the upper and lower surfaces, the first side surface including an upper curved surface section and a planar surface section extending from the upper curved surface section, the upper curved surface section is proximate to the upper surface, the second side surface including first and second curved surface sections and a planar surface section extending therebetween, and the first curved surface section is proximate to the upper surface and the second curved surface section is proximate to the lower surface.

6. The method of claim 5, wherein the longitudinal retaining slot of the elongate straight tube extends along a horizontal centerline of the tube.

7. The method of claim 5, wherein the retaining slot is formed in the planar surface section of the first side surface, and the rack includes a plurality of teeth that extend outward from the first side surface.

8. The method of claim 5, wherein the first side surface further includes a curved surface section proximate to the lower surface, and the lower surface is planar.

* * * * *